US007536966B2

(12) United States Patent
Stryjewski et al.

(10) Patent No.: US 7,536,966 B2
(45) Date of Patent: May 26, 2009

(54) SECTIONAL PONTOON BOAT

(76) Inventors: Terrence Stryjewski, 1305 W. 4th Ave., Brodhead, WI (US) 53520; Mary Stryjewski, 1305 2 4th Ave., Brodhead, WI (US) 53520

( * ) Notice: Subject to any disclaimer, the term of this patent is extended or adjusted under 35 U.S.C. 154(b) by 0 days.

(21) Appl. No.: 11/807,508

(22) Filed: May 29, 2007

(65) Prior Publication Data

US 2007/0295255 A1 Dec. 27, 2007

Related U.S. Application Data

(60) Provisional application No. 60/808,642, filed on May 26, 2006.

(51) Int. Cl.
*B63B 1/00* (2006.01)

(52) U.S. Cl. ..... 114/61.1

(58) Field of Classification Search ..... 114/61.1; 211/201

See application file for complete search history.

(56) References Cited

U.S. PATENT DOCUMENTS

| | | | | |
|---|---|---|---|---|
| 3,300,796 | A * | 1/1967 | Powers | 114/344 |
| 3,968,532 | A * | 7/1976 | Bailey | 114/352 |
| 5,123,665 | A * | 6/1992 | Levy | 280/35 |
| 5,868,091 | A * | 2/1999 | Gross et al. | 114/61.1 |
| 6,345,581 | B2 * | 2/2002 | Blanchard | 114/61.1 |
| 6,698,371 | B1 * | 3/2004 | Stoltzfus | 114/61.1 |
| 2002/0089146 | A1 * | 7/2002 | Dray | 280/414.1 |

* cited by examiner

*Primary Examiner*—Stephen Avila
(74) *Attorney, Agent, or Firm*—Ryan Kromholz & Manion S.C.

(57) ABSTRACT

A modular pontoon boat assembly comprising a railing assembly, a deck assembly comprising a plurality of panels, each of said panels interfitting with an adjacent panel. The deck assembly and the railing assembly are coupled to one another. A plurality of spaced apart cross supports supporting the deck assembly and are releasably secured to a plurality of pontoons. A carrier for the disassembled pontoon boat is also disclosed.

8 Claims, 7 Drawing Sheets

SECTIONAL PONTOON BOAT

RELATED APPLICATION

This application claims the benefit of co-pending U.S. Provisional Patent Application Ser. No. 60/808,642, filed 26 May 2006.

BACKGROUND OF THE INVENTION

The present invention relates to pontoon boats and, more specifically, to pontoon boats that may be collapsed into smaller sizes for storage and transportation.

Pontoons boats are quite commonly used for leisure. Typically, such boats employ a deck generally disposed between a pair of buoyant hull members such as pontoons. The deck area is preferably constructed as large as possible to provide optimum accommodation for people and/or equipment. Desired length of the boats can generally be accommodated as needed.

However, if the boat must be transported on the highway, the magnitude of the width can be limited by vehicle width limits for legal transportation on the road. In addition, although the weight of the boat is typically quite modest, the length and width dimensions of the boat can require a fairly large-dimension trailer. Typically, especially with respect to pleasure boats, vehicle width limits on the roads operate as a functional limit of the widths to which such boats are built.

Even given the above criteria regarding width limits of vehicles on roads, pontoon boats typically require use of trailers specially designed for pontoon boats, which makes such trailers especially costly, and of limited use. Accordingly, one common practice is for a pontoon boat owner to not purchase a trailer for the boat, but to rely on marina service organizations or other service operators to trailer the boat to a launch location at the beginning of a boating season and to remove the boat from the water when the boating season is over. As a result, use of the pontoon boat commonly may be limited to a single body of water in a given season. Further, since the boat is left in the water the entire season, plant life such as algae or mussels readily attach themselves to the vessel thereby hindering speed of the boat, and adding to the periodic task of cleaning the hull e.g. at the end of the boating season.

Efforts have been made to make transport of pontoon boats easier. For instance, Smidt, U.S. Pat. No. 6,095,079, discusses a folding pontoon boat. However, the boat is not a full size pontoon boat and cannot adequately support more than two people. Still, the boat must be transported behind another vehicle. Other boats, such as Pruonto, U.S. Pat. No. 4,562,786, can be disassembled for storage in a smaller area. However, there are many sections and parts that must be reassembled, which makes such actions more cumbersome than desired. Reassembly is not the most efficient process, as each of the deck sections requires border sections that must be fastened between each deck section.

Foldable pontoon boats, such as Jackson, U.S. Pat. No. 6,564,735, Little, U.S. Pat. No. 6,067,925, and Valliere, U.S. Pat. No. 6,003,458, have been contemplated in the prior art. While these boats reduce the storage and transportation space needed, there is still room for improvement. Most specifically, these boats still are transported by being pulled by a vehicle on a trailer. Thus, it would be advantageous to develop a full-size pontoon boat that can be easily and quickly collapsed and reassembled when necessary. Further, it would be advantageous that such a boat could be stored and transported without the need of a trailer or a similar vehicle, and would not require that the boat be towed by a vehicle. An ideal boat would balance the ability to disassembly the pontoon boat to a sufficient storable size so that it could be easily transportable without necessarily using a boat trailer, while allowing for the boat to be easily and quickly reassembled when being use.

SUMMARY OF THE INVENTION

The present invention provides a modular pontoon boat assembly that comprises a railing assembly, a deck assembly having a plurality of panels. Each of the panels interfits with an adjacent panel, with the deck assembly supporting the railing assembly and removably coupled to the deck assembly. The boat further comprises a plurality of spaced apart cross supports that are coupled to and support the deck assembly. A plurality of pontoons are releasably secured to the cross supports.

The present invention thus provides a collapsible pontoon boat that provides improved storage and transportation options. The boat can be transported on top of a vehicle, so that it is unnecessary to tow the boat or a trailer for the boat. A winch system may be employed to further assist in moving the boat onto the top of a vehicle when the boat is in a folded position. The boat is relatively lightweight and can be easily and quickly reassembled when necessary. Other features will become apparent with the disclosed drawings and further description.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
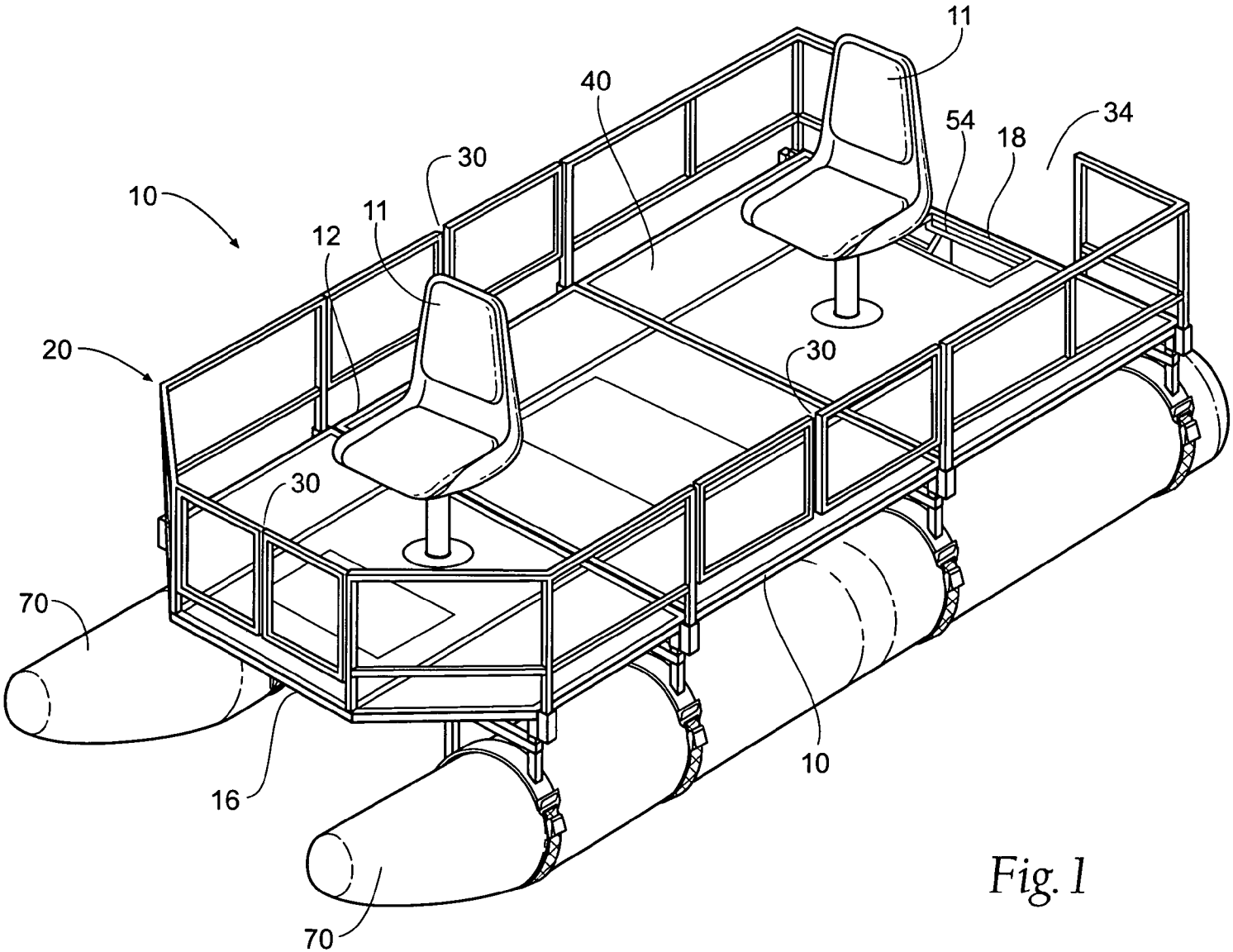
FIG. 1 is a perspective of a pontoon boat in accordance with the present invention.

FIG. 1 depicts a pontoon boat 10 according to the present invention. The pontoon boat 10 is a full-sized pontoon boat, yet can be folded up and stored, as will become evident from the following drawings and description. In a preferred embodiment, the floor space of the pontoon boat or boat assembly 10 is approximately 12'×6'. The boat 10 generally comprises a railing assembly 20, a deck assembly 40, and a pair of pontoons 70. The individual pontoons are designed from a durable, inflatable material, such as Hypelon® or another similar rubber material. The individual pontoons preferably have two chambers, with each chamber being sufficient to support the entire weight of the boat. When not in use, the pontoons can be deflated and easily stored away for future use. A pair of chairs 11 is located on and secured to the deck assembly 40, but are not necessary and any desired seating arrangement may be used with the boat 10.

Figure 2:
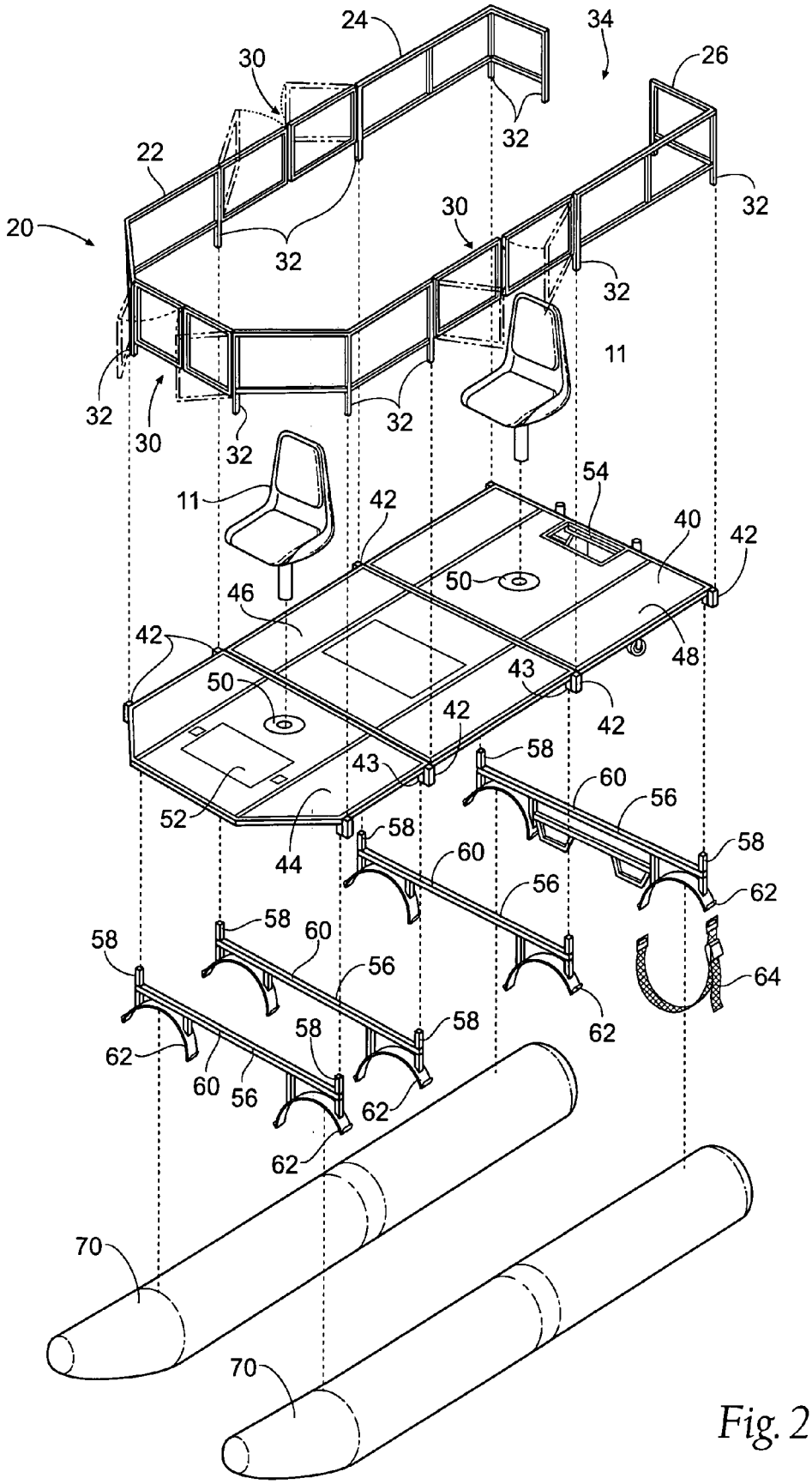
FIG. 2 is an exploded view of the pontoon boat of FIG. 1.

FIG. 2 provides an exploded view of the boat 10. The railing assembly 20 is preferably comprised of four railing sections, 22, 24, 26, and 28, with each of the section being arranged and designed for attachment around a perspective corner of the deck assembly 40, but other arrangements of the railing sections 22, 24, 26, and 28 will fall within the scope of the invention as well. For instance, the railing assembly 20 may be designed so that a deck portion would lie outside of the railing assembly 20 near the front 16 of the boat 10. The railing sections 22, 24, 26, and 28 preferably are formed of individual railing panels that are pivotal with respect to one another so that they can be easily folded and stored when the boat 10 is to be transported. The railing sections 22, 24, 26, and 28 preferably are arranged around the deck assembly 40 to form a plurality of gates 30, with a gate 30 located at the sides 12, 14 of the boat 10 and the front 16 of the boat 10 (see FIG. 1). The railing assembly 20 preferably does not extend completely across the rear 18 of the boat 10, thereby forming an opening 34 where a transom 54 would be located on the deck assembly 40 to support a motor (not shown). However, it is understood that any number of gates 30 or openings 34 may be incorporated into the railing assembly 20 and still fall within the scope of the present invention. Likewise, the number of railing sections could be increased or decreased and the arrangement would still fall within the scope of the present invention.

Still referring to FIG. 2, the deck assembly 40 is generally comprises a front desk section 44, a middle deck section 46, and a rear deck section 48. Each of the deck sections 44, 46, and 48 are fittingly secured in a direct fashion to an adjacent deck section. The deck section further comprises a plurality of mating areas 42, which are designed to receive respective posts 32 located on the railing assembly 20. The mating areas 42 are sized to fittingly mate with the posts 32 and for easy assembly and disassembly of the boat 10, and preferably are formed as polygonal shapes to assist in efficient orientation and mating of the posts 32 and the mating areas 42. The mating areas 42 and the posts 32 also assist in properly organizing the various components of the boat 10 when the boat is disassembled and stored. That is, the mating areas 42 and the posts 32 are preferably shaped and designed so that they could fit together with other mating sections for ease of storage purposes when mounting the various sections within or upon a storage caddie (see FIGS. 7-11), which is another advantage of the present invention over the prior art. While the posts 32 easily slide into the mating areas 42 and the mating areas 42 securely hold the posts 32 in position, it is possible to use further securing or coupling means to hold the railing assembly 30 and the deck assembly 40 together. Likewise, it is understood that the mating areas 42 could be located on the railing assembly 20 and the posts 32 could be located on the deck assembly, and the arrangement would still fall within the scope of the present invention.

The deck section can also incorporate other features as is necessary. For example, the front section 44 and the rear section 48 have inserts 50 for supporting the chairs 11, and a latch 52 that could lead to a storage area (not shown) located in the deck assembly 40. Provided that the deck assembly 40 comprises adjacent deck sections that are directly mated with and connected to one another, the deck assembly 40 sections will fall within the scope of the present invention.

The deck assembly 40 is supported by a plurality of spaced apart cross support members 56. The cross support members 56 are arranged to mate with the deck sections 44, 46, and 48. As shown, each of the cross support members 56 has a pair of post members 58 that are configured to mate with a respective lower mating area 43 located on the various deck sections 44, 46, 48. The post members 58 could also be located on the deck sections 44, 46, and 48, and the lower mating areas 43 and the mating areas 42 could be located on the cross support members 58, and the arrangement would still fall within the scope of the present invention. Similarly, the lower mating areas 43 and the mating areas 42 could be centrally aligned with one another, or be a single area, and the arrangement would stall fill within the scope of the present invention. However, it is possible that the cross support members 56 and the deck sections 44, 46, 48 could be fastened together in other manners or possibly designed as a single piece. For instance, the cross support members 56 could be pivotably secured to the deck sections 44, 46, 48, so that they may be stored together with the deck sections.

The cross support members 56 further comprise beam members 60, which provide the general support structure for the cross support members 56. Each of the beam members 60 are connected to a pair of oppositely disposed pontoon braces 62 that will rest upon and mate with the exterior of the pontoons 70. Securing means, such as straps 64, will secure the pontoon braces 62 to the pontoons 70. The pontoon braces 62 form a generally curved or partially-circular design that allows for easy mating and support by the pontoons 70. It is understood when discussing a curved or partially-circular design that there may be portions of the design that potentially would not be curved and the design would fall within the scope of the present invention. Generally, if the pontoon braces form an arched shape that generally follows the surface of the pontoons 70, the design would fall within the scope of the present invention. The design allows for sufficient space between the deck assembly 40 and the pontoons 70 and reduces the direct stress and force placed upon the pontoons 70 from shifting and moving of the deck assembly 40 when the boat is in use 10. That is, when the boat 10 is being used on a body of water, the natural forces of the water will cause the pontoons 70 to shift and sway. The present invention allows these forces to act on the boat, while minimizing stress between the pontoons 70 and the deck assembly 40. Such a design is an improvement over prior art designs that would attach a deck assembly directly to pontoons, which results in wear and tear on the pontoons and unnecessary force between the pontoons 40 and the deck assembly 40. Other securing means besides the straps 64 could be used to secure the braces 62 and the pontoons 70, such as clamps or structures that may entirely surround the pontoons 70. However, the use of straps 64 and the braces 62 provides for a solid, secure support, while still allowing for some movement of the pontoons 70 relative to the deck assembly 40, thereby reducing stress and wear on the pontoons 70.

Figure 3:
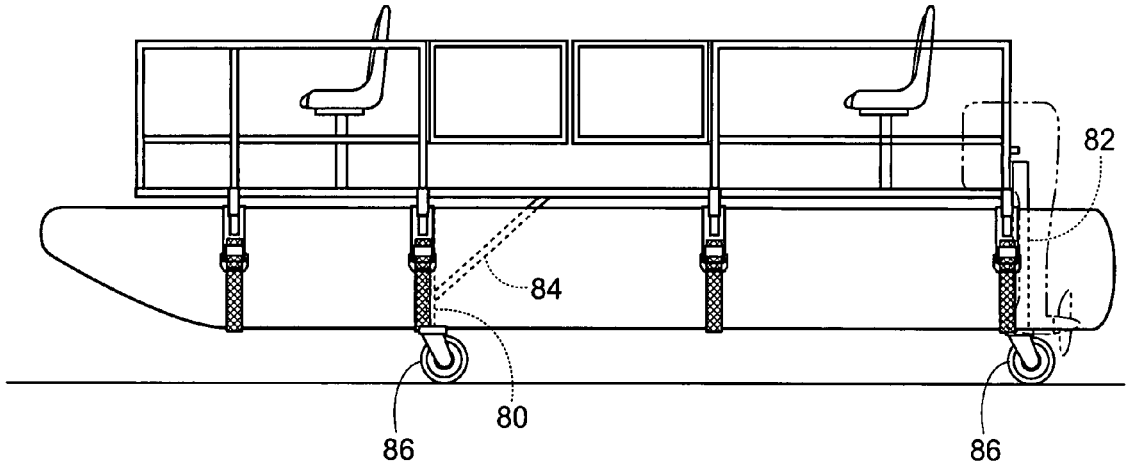
FIG. 3 is a side elevation view of the boat of FIG. 1.
Figure 4:
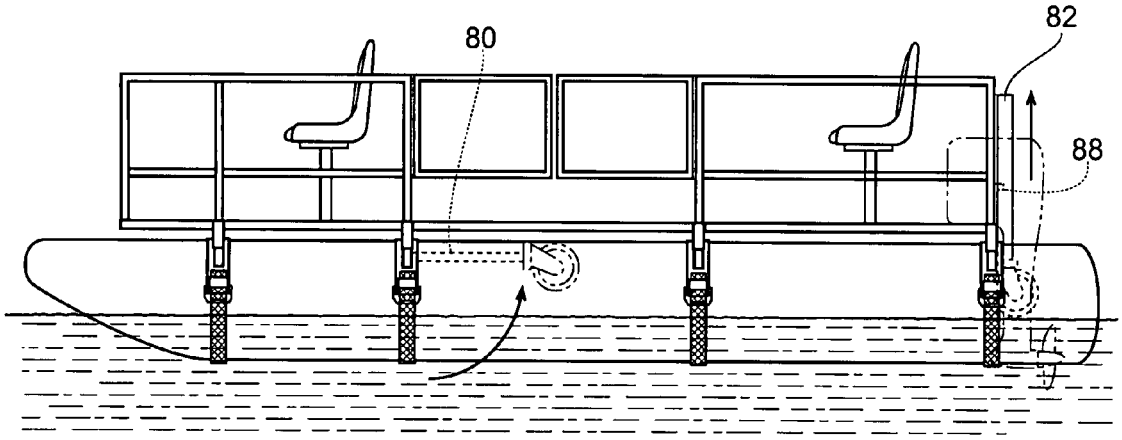
FIG. 4 is a side elevation view of the boat of FIG. 1 floating on a body of water.

FIGS. 3 and 4 provide side views of the boat 10 before and after being launched into a body of water. FIG. 3 shows the boat 10 being supported by a front support member 80 and a rear support member 82. The front support member 80 may further comprise a brace 84 that holds the front support member 80 in proper position. The brace 84 may be secured with any known fastening device. Both the front support member 80 and the rear support or support members 82 are supported by castors 86, which allow the boat 10 to be moved and rolled when on land. This is an improvement over prior designs, as well, since a boat trailer is not required as would be needed for previous pontoon boats. Referring to FIG. 4, the boat 10 has been launched on a body of water, and the supports 80 and 82 have been raised into a stored position. The front support member 80 is preferably pivoted upwardly towards the deck assembly 40, while the rear support members 82 are preferably slid upwardly and out of the way. The support members 82 can be held in place with releasable securing means 88, such as a series of holes and an indent pin or cotter pin. Provided that the supports 80 and 82 can be moved from a first position that allows transport of the boat 10 on land to a second position where the supports 80 and 82 do not interfere with movement of the boat 10 in a body of water, the arrangement would fall within the scope of the present invention.

Figure 5A:
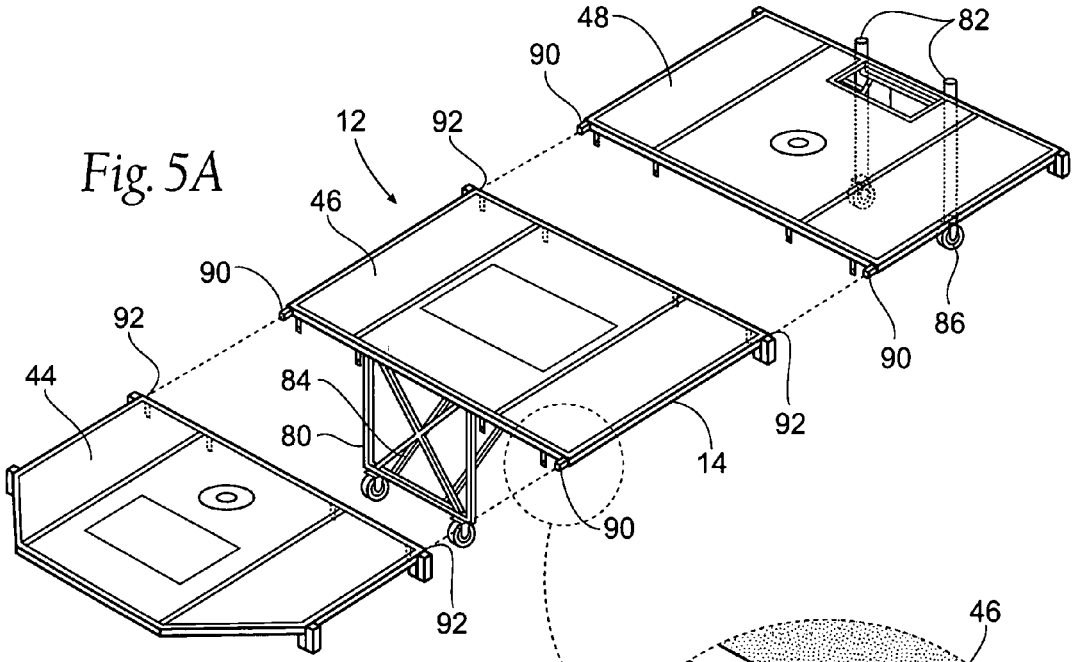
FIG. 5A is an exploded perspective view of a deck assembly used in connection with the present invention.
Figure 5B:
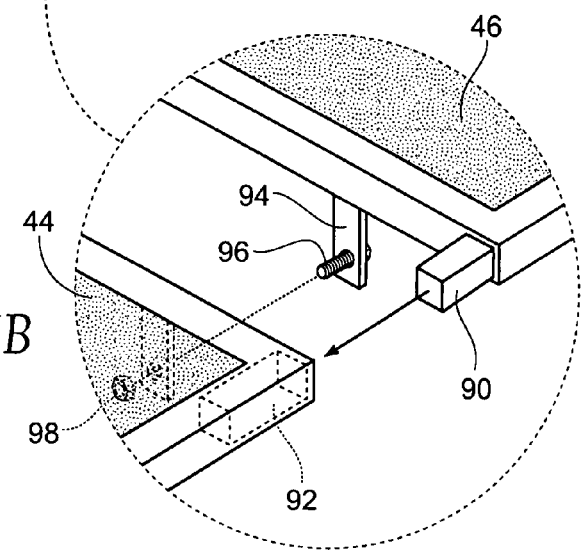
FIG. 5B is a sectional close-up perspective view of a coupling arrangement used with the deck assembly of FIG. 5A.
Figure 6:
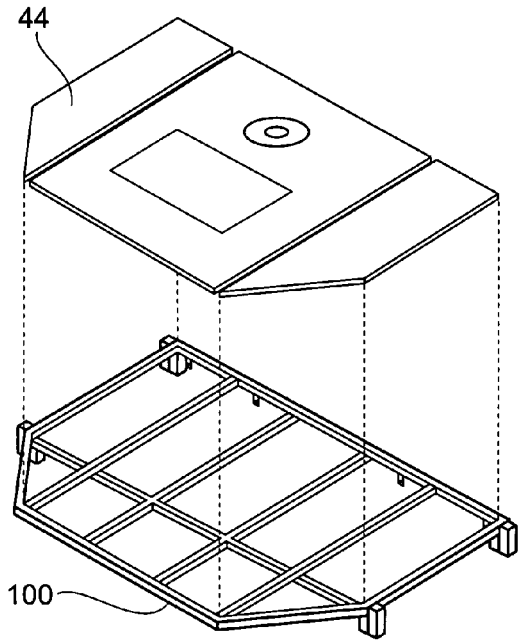
FIG. 6 is an exploded view of an individual deck section.

FIGS. 5A-6 further describe the arrangement of the deck sections 44, 46, 48. As previously noted, the deck sections 44, 46, and 48 are arranged to be secured and mate directly with an adjacent deck section 44, 46, and 48 without the need for borders or rails between the various deck sections. The deck sections 44, 46, 48 are generally secured to one another by way of a plurality of inserts 90 and mating receptacles 92, similarly to the mating arrangement described above for the railing assembly 20 and the deck assembly 40. Preferably, a pair of inserts 90 and receptacles 92 is spaced apart and located on each deck section 44, 46, 48, but any arrangement that will allow the deck sections 44, 46, 48 to be directly secured to one another, including more or fewer inserts 90 and receptacles 92, is understood to fall within the scope of the present invention. As shown in FIG. 5B, the insert 90 is fittingly slid into the receptacle 92. Additional fastening means may be used to join the sections 44, 46, 48 together. For instance, FIG. 5B shows a strut 94 located on the middle deck section 46. The strut 94 supports a bolt 96, which is arranged to interact and be secured to the deck section 44 by way of a nut 98, further insuring the deck sections 44, 46, and 48 are sufficiently secured to one another.

FIG. 6 shows an exploded view of the front deck section 44 and a frame member 100. The deck section 44 and the frame member 100 are preferably permanently secured to one another for ease of assembly, but it is possible that they would be fabricated as separate pieces and secured to one another by the user.

Figure 7:
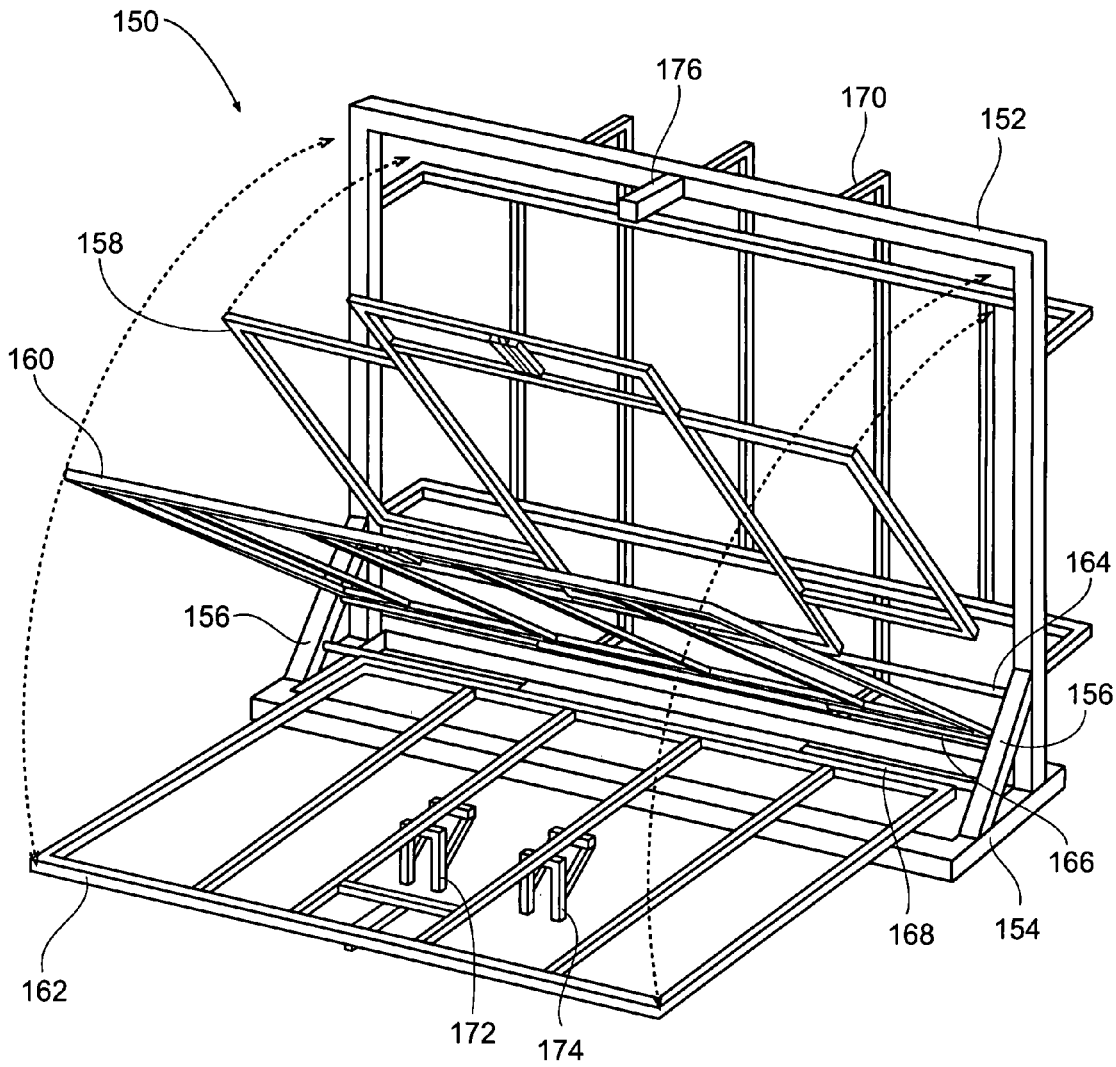
FIG. 7 is a perspective view of a storage device use in connection with the pontoon boat of FIG. 1.

FIG. 7 shows a storage caddy 150 according to the present invention. The caddy 150 is designed for easy and efficient storage of the various sections of the boat 10 so that it will be easily transported and stored when not being used. Further, the storage caddy 150 allows for easy removal of the various boat sections 10 so that reassembly of the boat 10 can be accomplished quickly and easily. FIG. 7 shows the caddy 150 without any parts or sections of the boat 10 being stored on the caddy 150. The caddy generally comprises an upright section 152 and a base section 154. The base section 154 further comprises struts 156, which provide stability to the caddy 150. Partitions 158, 160, 162 are pivotally connected to the struts 156 by way of cross bars 164, 166, and 168, respectively. The partitions provide means for organizing and arranging the various sections of the disassembled boat 10. The caddy 150 also comprises a rear bracket 170 that provides a solid structure or backrest when the various boat 10 sections are loaded on the caddy 150. The caddy 150 can be designed with various other brackets, such as brackets 172 and 174, that can be used to mount various sections of the boat 10.

Figure 8:
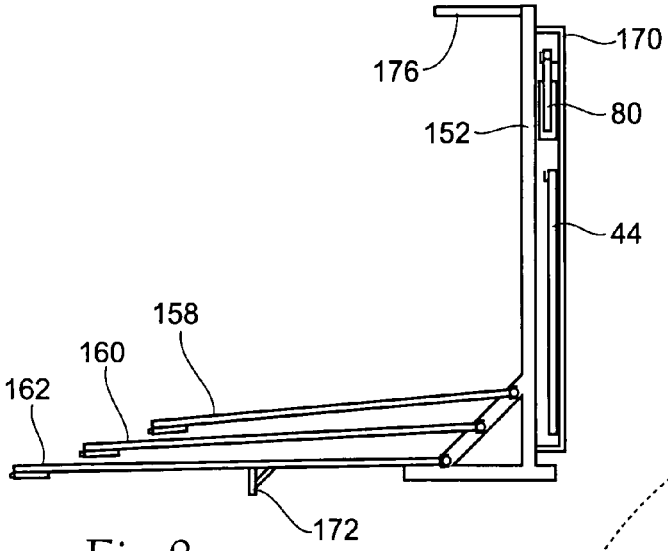
FIG. 8 is a side view of the storage device of FIG. 7 supporting a portion of the pontoon of the present invention.

FIGS. 8-11 show side views of the caddy 150 with various sections of the boat 10 being stored on the caddy. FIG. 8 shows the caddy 150 supporting the rear deck section 48 and the railing sections 24 and 26. If the cross support members 56 are made as separate sections from the deck sections 44, 46, 48, one or more of the cross support members 56 could also be stored on the caddy 150 as shown in FIG. 8. Once these sections have been mounted onto the caddy 150, the partition 158 will be pivoted upwardly to secure these sections in place.

Figure 9:
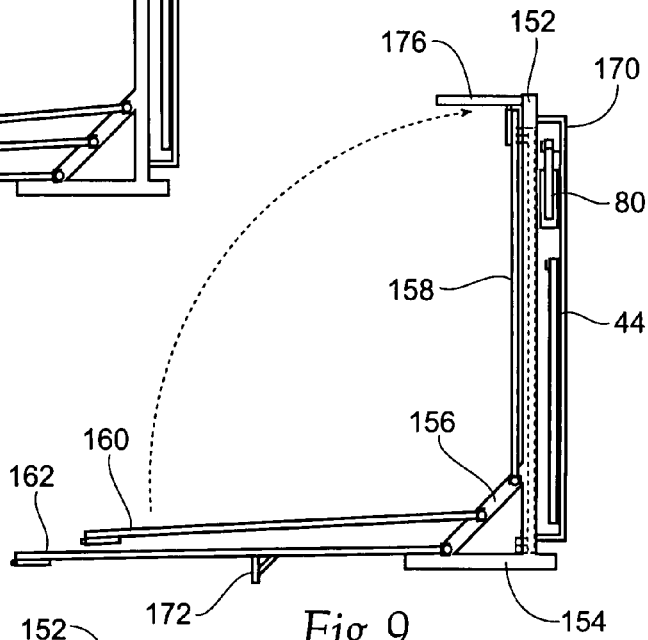
FIG. 9 is a side view of the storage device of FIG. 7 supporting a further portion of the pontoon of the present invention.
Figure 10:
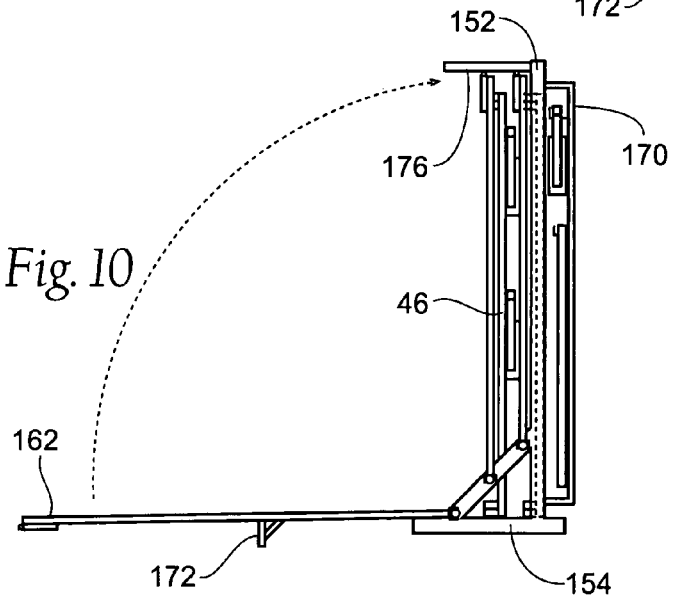
FIG. 10 is a side view of the storage device of FIG. 7 supporting another portion of the pontoon of the present invention.
Figure 11:
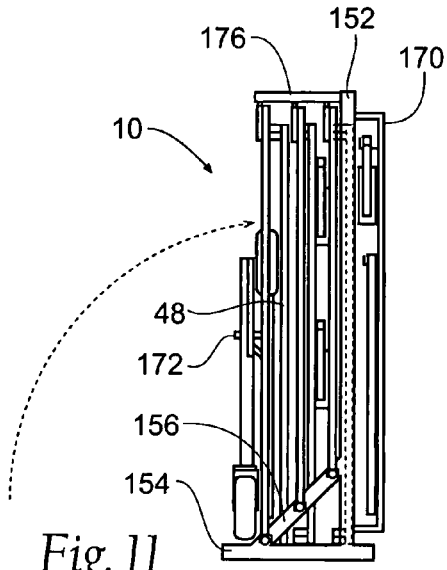
FIG. 11 is a side view of the storage device of FIG. 7 being loaded with and supporting the pontoon boat of the present invention.

FIG. 9 depicts further sections of the boat 10 being loaded onto the caddy 150. The middle deck section 46 and another railing section, such as railing section 22, are mounted on the caddy 150 and the partition 160 is pivoted upward to secure these sections in place. FIG. 10 shows further sections being mounted on the caddy 150, such as the front deck section 44 and the railing section 28, with the partition 162 being pivoted upwardly to further secure the various sections in place. Any remaining portions of the deck assembly 40 or the railing assembly 20, such as the supports 80 and 82, can be mounted on the caddy 150, possibly secured to the brackets 172 and 174. The partition 162 will be locked or secured to the caddy 150, possibly by latching or joining the partition to a post 176 located on the upright section 152. The caddy 150 may incorporate an area for storage of the pontoons 70, or they may be stored in a different area.

It is understood that the various sections of the boat 10 do not need to be mounted on the caddy 150 in the order presented. Preferably, the sections will be mounted in a fashion as they would be assemble, i.e. from the rear 18 of the boat 10 to the front 16 of the boat 10, or vice versa, but any manner of mounting the various sections is acceptable. The design of the connecting means of the various boat 10 sections also contributes to the ease of storing the boat 10 on the caddy 150. For example, the various posts 32, post members 58, and inserts 90 are preferably of the same dimensions, as are the upper and lower mating areas 42 and 43, and the receptacles 92. This allows the various sections to be temporarily mated with one another so that they may be more easily mounted on the caddy 150. The caddy 150 allows for easy organization of the various sections of the boat 10 so that it can be quickly and efficiently reassembled.

When the boat is stored as in the currently shown embodiment in FIGS. 7-11, the boat preferably will comprise an approximate area of 87"×56"×21", which can be easily stored on top of a motor home, RV, or other vehicle. This will allow the user to tow another vehicle behind the RV, such as a car. This is advantageous for people who are traveling long distances for extended periods of time, such as people who spend winters in southern areas, such as Florida. Also, when not in use, the boat can be easily stored by hanging, which will allow the boat to be stored in a garage or similar building while still being able to park a vehicle within the building.

Figure 12:
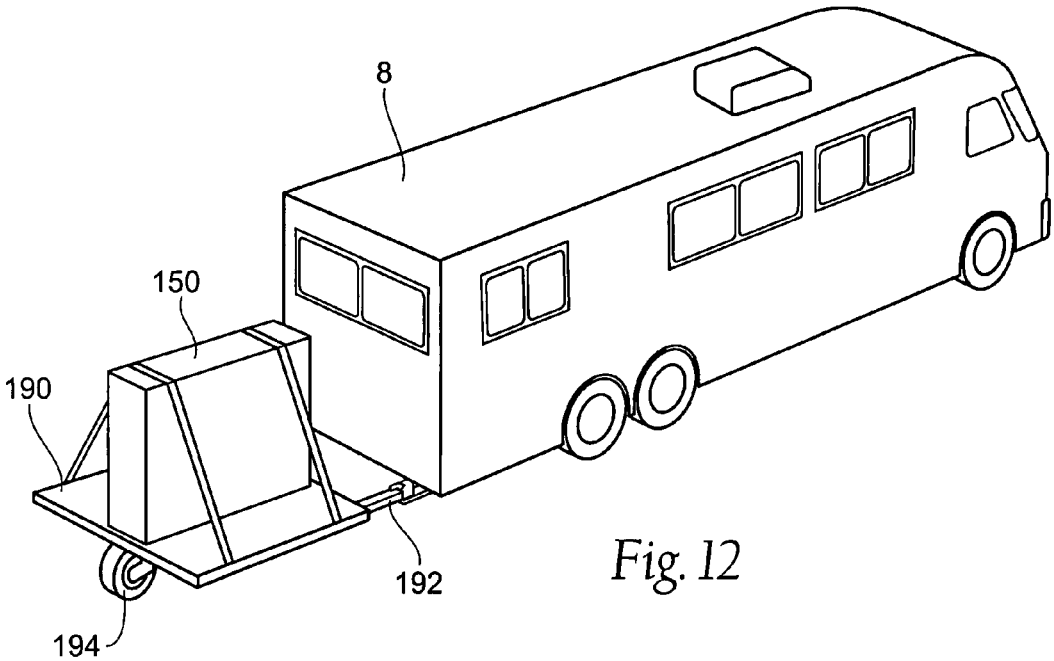
FIG. 12 is a perspective view of a storage device supporting the pontoon boat and being carried by a trailer.
Figure 13:
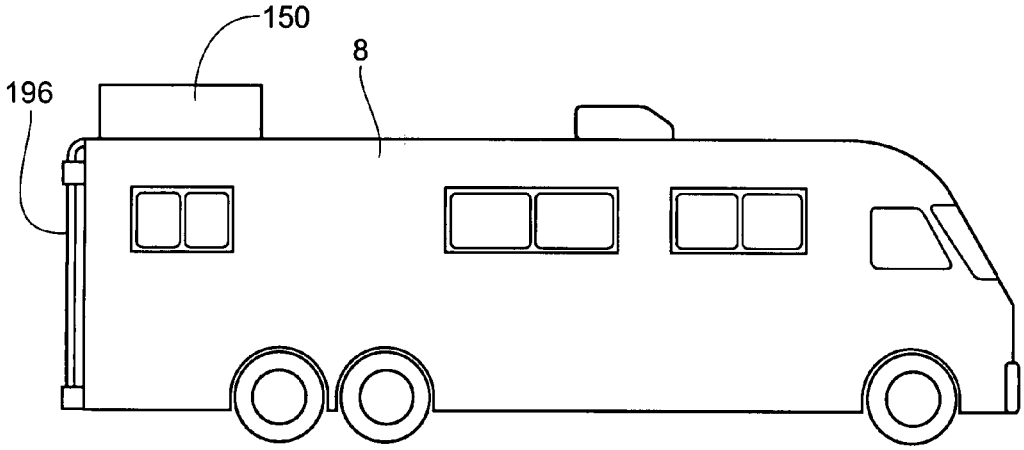
FIG. 13 is a side view of the pontoon boat and storage device being carried on top of a motor home.
Figure 14:
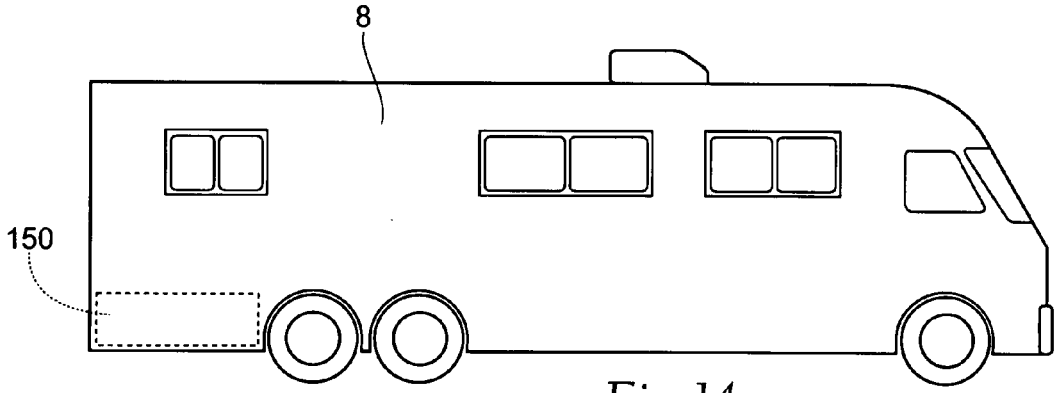
FIG. 14 is a side view of the pontoon boat and storage device being carried underneath a motor home.

FIGS. 12-14 shows the caddy 150 and the boat 10 being transported by a motor home 8. FIG. 12 shows the caddy 150 carried by a trailer 190. The trailer 190 may be of any design, but preferably is a one-wheel trailer, having an individual wheel 194 and tongues 192 for attachment to the motor home 8. However, as shown in FIGS. 13 and 14, it is not necessary to use a trailer. The caddy 150 could be stored on top of the motor home 8 (FIG. 13) or underneath the motor home 8 (FIG. 14), which is possible with larger styles and makes of motor homes. If the caddy 150 is to be stored on top of the motor home 8, a winch or pulley system 196 may be incorporated into the caddy 150 or the motor home 8.

The present invention has several advantages over the prior art. The caddy 150 and the boat 10 can be stored without taking up a large area. The caddy 150 allows for the boat 10 to be stored in an organized fashion, which allows for the boat 10 to be quickly assembled without requiring any special tools or supports when assembling. The invention also minimizes the necessary interacting parts and sections needed to provide a full size pontoon boat. Further, the present invention removes the necessary requirements of a trailer or other vehicle required to transport or launch a pontoon boat, while still providing for a full size pontoon boat.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A modular pontoon boat assembly comprising:

a railing assembly, comprising a plurality of individual railing sections;

a deck assembly comprising a plurality of panels extending widthwise of said pontoon boat, each of said panels directly interfitting with an adjacent panel, said deck assembly supporting said railing assembly;

means for removably coupling said railing assembly to said deck assembly said coupling means further comprises a plurality of posts located on one of said railing assembly or said deck assembly and a plurality of respective mating areas located on the other of said deck assembly or railing assembly;

a plurality of spaced apart cross supports extending widthwise of said pontoon coupled to and supporting said deck assembly, said cross supports being substantially the same width as said panels; and a pair of inflatable pontoons being releasably securable to said cross supports, said pontoons being spaced apart from said deck assembly;

said cross supports further comprises a plurality of pontoon braces being spatially separated from where said cross supports are coupled to said deck assembly, said braces having at least a portion thereof being curved and a portion thereof arranged to releasably encircle and mate with a respective one of said pontoons.

2. The boat assembly according to claim 1 further comprising support members connected to said deck assembly, said support members providing means for launching an assembled boat assembly into a body of water.

3. The boat assembly according to claim 1 wherein said cross supports are removably secured to said deck assembly.

4. The boat assembly according to claim 1 wherein said cross supports are pivotally connected to said deck assembly.

5. The modular assembly according to claim 1 wherein said said portion thereof of said brace being arranged to encircle said pontoon comprises at least one strap.

6. The modular boat assembly according to claim 1 further comprising a plurality of lower mating areas located on one of said deck assembly or said cross support members and a plurality of inserts located on the other of said cross support members or said deck assembly, said plurality of lower mating areas being releasably matable with said plurality of inserts.

7. A modular pontoon boat assembly kit comprising:

a modular pontoon boat according to claim 1; and a caddy for supporting said modular pontoon boat when said modular pontoon boat is disassembled, said caddy further comprises:

a base section;

an upright section extending upwardly from said base section; and a plurality of partitions connected to said base section, said partitions providing means for organizing said modular pontoon boat.

8. The kit according to claim 7 wherein said plurality of partitions are pivotally connected to said base section.

* * * * *